United States Patent [19]

Machida et al.

[11] Patent Number: 4,773,835

[45] Date of Patent: Sep. 27, 1988

[54] SCROLL TYPE PUMP WITH WRAP CURVE OFFSET FOR THERMAL EXPANSION

[75] Inventors: Shigeru Machida, Ibaraki; Katsumi Matsubara, Ushiku; Toshio Kushiro, Kawanishi; Makoto Uenishi, Nishinomiya; Kazuaki Miyazaki, Hyogo, all of Japan

[73] Assignees: Hitachi, Ltd.; Shin Meiwa Industry Co., Ltd., both of Tokyo, Japan

[21] Appl. No.: 137,340

[22] Filed: Dec. 23, 1987

[30] Foreign Application Priority Data

Dec. 29, 1986 [JP] Japan ..... 61-312520

[51] Int. Cl.[4] ..... F04C 18/04; F04C 29/04

[52] U.S. Cl. ..... 418/55; 418/83; 418/150

[58] Field of Search ..... 418/55, 83, 150

[56] References Cited

U.S. PATENT DOCUMENTS 4,382,754 5/1983 Shaffer et al. ..... 418/55

4,490,099 12/1984 Terauchi et al. ..... 418/55

*Primary Examiner*—John J. Vrablik

*Attorney, Agent, or Firm*—Antonelli, Terry & Wands

[57] ABSTRACT

A scroll type pump has a fixed scroll and an orbiting scroll engaging therewith, wherein a curve of a wrap of either of the scrolls is offset inwardly or outwardly relative to a set curve so as to prevent formation of a gap between the wraps due to thermal expansion of the scroll wraps.

14 Claims, 3 Drawing Sheets

SCROLL TYPE PUMP WITH WRAP CURVE OFFSET FOR THERMAL EXPANSION

BACKGROUND OF THE INVENTION

1. Field of the Invention

The present invention relates to a scroll type pump, and, more particularly, to a scroll type pump, such as a vacuum pump, which is of an oil free type and suitable for attaining high performance and high reliability.

2. Statement of the Related Art

A scroll type fluid pump include a housing, a pair of scroll members each comprising an end plate and a spiral wrap means projecting from one surface of the end plate. Both wrap means are engaged with each other to make a plurality of line contacts between them, and a driving mechanism including a drive shaft is connected to one of the scroll members to effect orbital motion thereof relative to the other (fixed) scroll member while rotation of the orbiting scroll is prevented.

If a scroll type fluid apparatus is operated in an oil free system, an orbiting scroll is heated by the heat generated due to compression of the fluid, and if the machine is operated as a vacuum pump, it becomes impossible to expect the transfer of compressional heat and the cooling by the lubricating oil which has been conventionally employed. At the same time, since the orbiting scroll is placed in vacuum, it becomes impossible to expect the cooling to be obtained by the dissipation of heat through convection. Therefore, the temperature of the orbiting scroll tends to become high. On the other hand, an outer wall of the fixed scroll is generally disposed in an atmospheric environment and the cooling or dissipation of heat from other surface of the outer wall through convection can be made relatively effectively. Accordingly, the fixed scroll can be cooled relatively effectively and the temperature of the fixed scroll can be kept relatively low. Consequently, the temperature of the orbiting scroll becomes higher than that of a fixed scroll. As a result, distortion occurs in a wrap of the orbiting scroll due to thermal expansion.

In a scroll compressor for refrigeration or airconditioning, partly due to the fact that the suction gas is cold, the rise in temperature in the vicinity of a center portion of the wrap is greater than that in the other outer peripheral portion, with the result that the degree of distortion experienced by the wrap is large. There has accordingly been a problem in that the gap between the wraps becomes large at the center portions thereof which results in leakage of fluid, thereby causing a decline in the compression performance.

As a countermeasure against this problem, a scroll type fluid displacement apparatus is disclosed in the specification of U.S. Pat. No. 4,490,099. In this apparatus, the center portions of the wraps are made slightly thicker than the remaining portions thereof and leakage of fluid in the center portions of the wraps is prevented, thereby improving the performance of the apparatus.

In a scroll type vacuum pump, the suction side assumes a vacuum in which the flow rate of a gas is small. Therefore, in case of the orbiting scroll since substantially no heat dissipation occurs, the temperature in an outer peripheral portion thereof also rises and thus thermal expansion takes place. The farther the outer peripheral portion is from the center, the greater is the amount of this thermal expansion. If the orbiting scroll undergoes thermal expansion, an outer wall surface and an inner wall surface of the wrap are deformed radially to approach the inner wall surface of the wrap of the fixed scroll and to become remote from the inner wall surface of the wrap of the fixed scroll. According to the above-described prior art, however, since sufficient consideration is not paid to the radial thermal expansion of outer peripheral portions of the wraps of the orbiting scroll and the fixed scroll, there has been a problem in that the side wall surfaces of the wraps are brought into contact with each other particularly in the outer peripheral portions thereof and vibrations occur as a result of that contact.

SUMMARY OF THE INVENTION

Accordingly, it is an object of the present invention to provide a scroll type pump which is capable of operating by constantly maintaining a very small gap between a wrap of an orbiting scroll or orbit scroll member and a wrap of a fixed scroll or fixed scroll member.

To this end, according to the present invention, there is provided a scroll type pump having an orbiting scroll provided with a wrap constituted by a spiral projection on a plate and a fixed scroll provided with a wrap constituted by a spiral projection on another plate the scrolls being engaged with each other at an offset of 180 degrees, and adapted to compress or expand a fluid by allowing the orbiting scroll to effect orbital motion relative to the fixed scroll without rotating the orbiting scroll, wherein the wrap of the fixed scroll has a fixed thickness and is formed spirally along a set curve, and the wrap of the orbiting scroll is arranged such that the radius of an inscribed circle between side walls of the wrap becomes gradually smaller as it moves from the beginning of a spiral in a center portion of the wrap toward the end of the spiral in an outer peripheral portion thereof. In case of modifying the shape or configuration of the fixed scroll, the wrap of the fixed scroll is arranged such that the radius of an inscribed circle between side walls of the wrap becomes gradually greater as it moves from the beginning of a spiral in a center portion of the wrap toward the outer end of the spiral.

If the above-described arrangement is adopted, even if thermal expansion occurs in the radial direction, the outer wall surface of the orbiting scroll does not collide with the inner wall of the fixed scroll and a small gap is maintained therebetween. On the other hand, the inner wall surface of the orbiting scroll and the outer wall of the fixed scroll are separated so remote from each other but an appropriately small gap is maintained between the two surfaces.

The foregoing and other objects, features and advantages of the present invention will become more apparent from the following detailed description of embodiments of the invention referring to the accompanying drawings.

DETAILED DESCRIPTION OF THE PREFERRED EMBODIMENTS

Referring now to the accompanying drawings, a description will be made of the preferred embodiments of the present invention.

Figure 2:
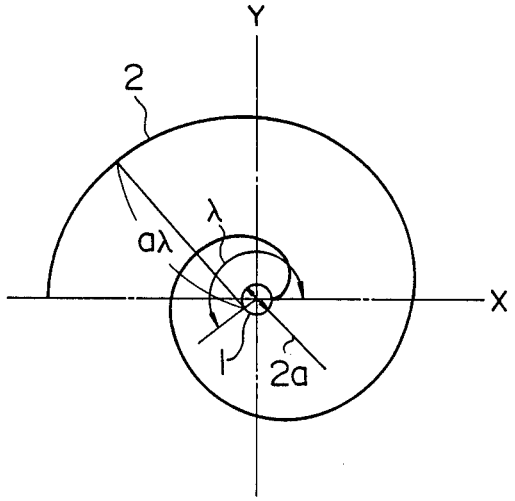
FIG. 2 is a diagram illustrating an involute curve.

First, description will be made of a scroll wrap in the form of an involute curve. FIG. 2 illustrates an involute curve 2 with respect to a base circle 1. If it is assumed that the diameter of the base circle is 2*a*, and the spiral angle is λ, a locus depicted by a point which is separated from the base circle 1 by a λ becomes the involute curve 2 to be obtained, which can be expressed by the following equations in the X - Y coordinates:

$$\left.\begin{aligned} x &= a(\cos\lambda + \lambda\sin\lambda) \\ y &= a(\sin\lambda - \lambda\cos\lambda) \end{aligned}\right\} \quad (1)$$

Next, to form a scroll wrap, it is necessary to make a tooth thickness, i.e., a wrap thickness t. If it is assumed that $\beta = t/a$, the scroll wrap can be formed by equations (1) and the following equations (2):

$$\left.\begin{aligned} x &= a\{\cos\lambda + (\lambda - \beta)\sin\lambda\} \\ y &= a\{\sin\lambda - (\lambda - \beta)\cos\lambda\} \end{aligned}\right\} \quad (2)$$

Figure 3:
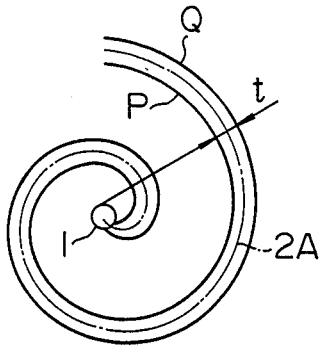
FIG. 3 is a diagram schematically illustrating a configuration of the wrap.

In the present invention, a curve expressed by the above equations (1) and (2) is called a theoretical involute curve. This curve is illustrated in FIG. 3. Equations (1) and (2) indicate an outer wall surface Q of the wrap and an inner wall surface P of the wrap, respectively, of the theoretical involute curve 2A.

Figure 1:
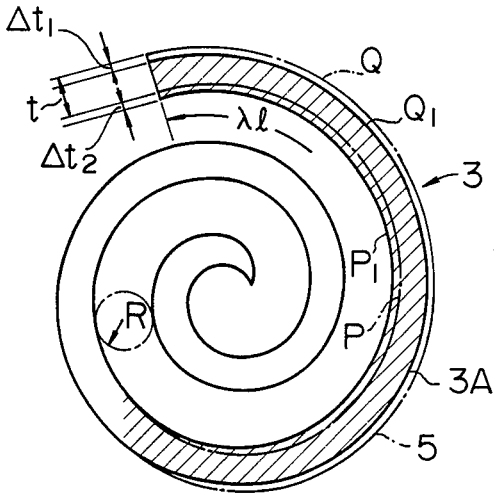
FIG. 1 is partial plan view of a wrap of an orbiting scroll in accordance with a first embodiment of the present invention.

FIG. 1 is a case where the present invention is applied to the side of an orbiting or orbit scroll member or scroll 3 of a scroll type vacuum pump in accordance with a first embodiment of the present invention. For the sake of convenience, the aforementioned embodiment is illustrated partially. In other words, although the present invention is applied to an area ranging from a center portion of the wrap to an outer peripheral portion thereof, the description given here relates to the outer peripheral portion. As for the remaining center portion, a description will be given with reference to FIG. 4. The scroll type vacuum pump in accordance with the present invention comprises the orbiting scroll 3 provided with a spiral projection on a plate (not shown) as well as a fixed scroll 6 (see FIG. 6) which is similarly provided with a spiral projection on a plate (not shown). This pump effects compression or expansion of a fluid by allowing the scrolls or scroll members 3, 6 to be engaged with each other at a point where they are offset from each other 180 degrees and causing the orbiting scroll 3 to orbit relative to the fixed scroll 6 without causing the orbiting scroll 3 to rotate or revolve.

In FIG. 1, an outer wall surface Q1 (shown by a solid line) of a wrap 3A of the orbiting scroll 3 in accordance with the present invention is formed such as to be offset inwardly by $\Delta t_1$ as an amount of offset Δt from the outer wall surface Q of the wrap, in correspondence with the amount of thermal expansion of the wrap 3A and the amount of inclination accompanying a precession proper to the orbiting scroll 3, at an end portion thereof at which the spiral angle λ is λl, thereby reducing the thickness of the wrap 5. Meanwhile, the inner wall surface $P_1$ of the wrap 3A is formed such as to be offset inwardly from an inner wall surface P by an amount of offset $\Delta t_2$ thereby to increase the thickness of a wrap 5. These two amounts of offset $\Delta t_1$, $\Delta t_2$ are set such as to decrease in parallel with a reduction in the spiral angle λ toward the inside (the side of the base circle 1), and can be expressed by the following Formulae (3) and (4). In other words, the curve of the outer wall surface $Q_1$ of the wrap can be expressed by equations:

$$\left.\begin{aligned} x &= a\left\{\cos\lambda + \lambda\left(1 - \frac{\Delta t_1}{a\lambda l}\right)\sin\lambda\right\} \\ y &= a\left\{\sin\lambda - \lambda\left(1 - \frac{\Delta t_1}{a\lambda l}\right)\cos\lambda\right\} \end{aligned}\right\} \quad (3)$$

The curve of the inner wall surface $P_1$ can be expressed by equations:

$$\left.\begin{aligned} x &= a\left\{\cos\lambda + \left(\lambda - \beta - \frac{\Delta t_2\lambda}{a\lambda l}\right)\sin\lambda\right\} \\ y &= a\left\{\sin\lambda - \left(\lambda - \beta - \frac{\Delta t_2\lambda}{a\lambda l}\right)\cos\lambda\right\} \end{aligned}\right\} \quad (4)$$

As is apparent from the above formula (3) and (4), the amount of offset Δt from the theoretical involute curve 2A, which is a theoretical curve, can be given starting with the beginning point of the spiral at the center portion of the wrap 5. In this case, the fixed scroll 6 which constitutes the opposing wrap is in the form of a theoretical involute curve (i.e., an envelope formed by the orbiting motion of the wrap 5 shown in FIG. 1 with an orbiting radius). An actual orbiting radius $\epsilon_R$ of the orbiting scroll 3 is derived from a theoretical orbiting radius ϵth (a maximum value for effecting motion of the scrolls in engagement with each other), determined from the theoretical involute curve 2A as well as the amount of offset $\Delta t_2$ which apparently increases the wrap thickness t, and is a fixed orbiting radius satisfying the condition: $\epsilon_R \leqq \epsilon th - \Delta t_2$. In addition, as shown in FIG. 1, if an inscribed circle radius between adjacent portions of the projection of the orbiting scroll 3 is assumed to be R, $\epsilon th = (2R - t)/2$. Thus, the inscribed circle radius R is set such as to become smaller as it moves from the beginning of the spiral (the side of the base circle 1) toward the end of the spiral.

Furthermore, as to the amounts of offset $\Delta_t$ of the outer wall surface $Q_1$ of the wrap and of the inner wall surface $P_1$ thereof, the amount of offset in the direction of reducing the wrap thickness t from the theoretical involute curve 2A is equal to or greater than that in the direction of increasing the wrap thickness t from the theoretical involute curve 2A. Namely, the relationship of the amounts of offset in this case is given by the condition: $\Delta t_1 \geqq \Delta t_2$. When $\Delta t_1 = \Delta t_2$, it means that the outer wall surface $Q_1$ of the wrap and the inner wall surface $P_1$ thereof are offset by the same dimentional amount from the theoretical involute curve 2A without changing the wrap thickness t. In addition, if it is assumed that the distance from the center of the orbiting scroll 3 is D, a coefficient of thermal expansion is $\alpha$, and a temperature rise is $\Delta T$, it is possible to maintain the relationship of $\Delta t_1 \geqq D\alpha\Delta T$.

The operation of the first embodiment of the present invention will now be described.

When the orbiting scroll 3 is subjected to thermal expansion, the outer wall surface $Q_1$ of the wrap is deformed in such a manner as to approach the inner wall surface of the fixed scroll 6, while, conversely, the inner wall surface $P_1$ of the wrap is deformed in such a manner as to be spaced away from the outer wall surface of the fixed scroll 6. The outer wall surface $Q_1$ of the wrap is offset inwardly from the outer wall surface Q of the wrap of the theoretical involute curve by the amount of offset $\Delta t_1$, while the inner wall surface $P_1$ of the wrap is offset inwardly from the inner wall surface P of the theoretical involute curve 2A by the amount of offset $\Delta t_2$. Consequently, even if the orbiting scroll is thermally expanded the outer wall surface $Q_1$ of the wrap of the orbiting scroll 3 will not be forced to be pressed against the inner wall surface of the fixed scroll 6, and a small gap can be maintained therebetween. Meanwhile, the inner wall surface $P_1$ of the orbiting scroll 3 and the other outer wall surface of the fixed scroll 6 are separated from each other by a gap which is not large but sufficient to ensure that space is maintained between the two surfaces.

Figure 4:
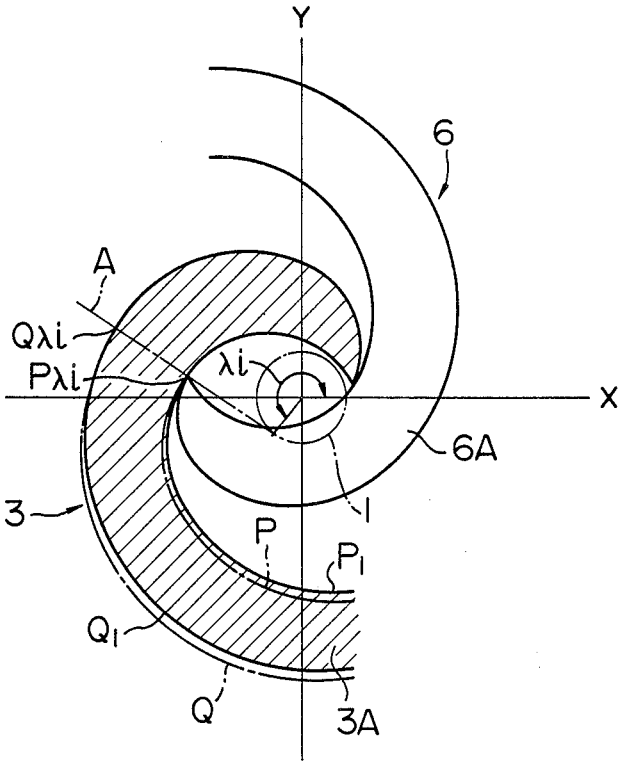
FIG. 4 is a partial plan view illustrating the state of engagement between the center portions of the wraps of the orbiting scroll and a fixed scroll.

FIG. 4 illustrates the configuration of the center portion of the wrap 3A of the orbiting scroll 3 shown in FIG. 1. In FIG. 4, reference numeral 6A denotes the wrap of the fixed scroll 6. There is a minimal hermetic space formed by the wraps 3A, 6A inside a boundary defined by a tangential line A of the base circle 1 at a spiral angle $\lambda i$, and the wrap wall surfaces are offset from the involute curves on the inner side of this tangential line A in the light of production technology, so that it is not necessary to apply the present invention to this area. However, a sealing line formed by the wraps 3A, 6A is located outwardly of the tangential line A, so that it is necessary to apply the present invention there.

If it is assumed here that the points of contact between the tangential line A and the outer wall surface $Q_1$ of the wrap and between the tangential line A and the inner wall surface $P_1$ of the wrap are $Q\lambda i$ and $P\lambda i$, respectively, it is possible to form the outer wall surface $Q_1$ of the wrap to be offset from the theoretical involute curve Q as well as the inner wall surface $P_1$ of the wrap to be similarly offset from the theoretical involute curve P outwardly of the point of contact $P\lambda i$ defining the minimal hermetic space therein and the point of contact $Q\lambda i$ located on a line normal to a line tangential to a curve $P_1$ at the point $P\lambda i$.

Figure 5:
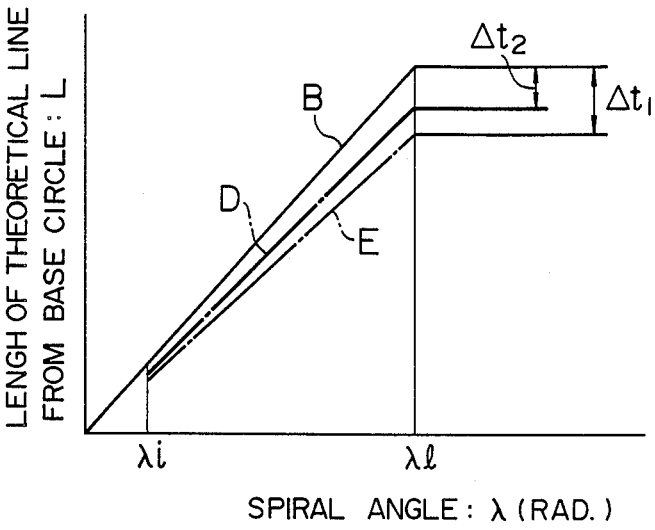
FIG. 5 is a diagram illustrating the relationship between a spiral angle and the length of a tangential line.

FIG. 5 shows the relationship of the length L of a tangential line from the base circle 1 relative to the spiral angle $\lambda$. In the drawing, a straight line B corresponds to the case of the theoretical involute curve 2A, where the length of the tangential line L is represended by $L=a\lambda$. $\lambda i$ indicates the spiral angle for forming the minimal hermetic space, as already mentioned, while $\lambda l$ indicates the spiral angle at the outer end of the spiral. In addition, the straight line D corresponds to the case of the inner wall surface $P_1$ of the wrap, where the length L of its tangential line is proportional to the spiral angle $\lambda$ and is represented by a formula:

$$L = a\lambda - \frac{\Delta t_2 \lambda}{\lambda l}, \lambda i \leqq \lambda \leqq \lambda l$$

Furthermore, a straight line E corresponds the case of the outer wall surface $Q_1$ of the wrap, where the length L of its tangential line is represented by the following formula:

$$L = a\lambda - \frac{\Delta t_1 \lambda}{\lambda l}, \lambda i \leqq \lambda \leqq \lambda l$$

Thus, since the amount of offset $\Delta t_1$ is set in correspondence with the amount of the thermal expansion of the orbiting scroll 3 during operation, it is possible to avoid collision or forced contact between the wrap 3A of the orbiting scroll 3 and the wrap 6A of the fixed scroll 6.

Figure 6:
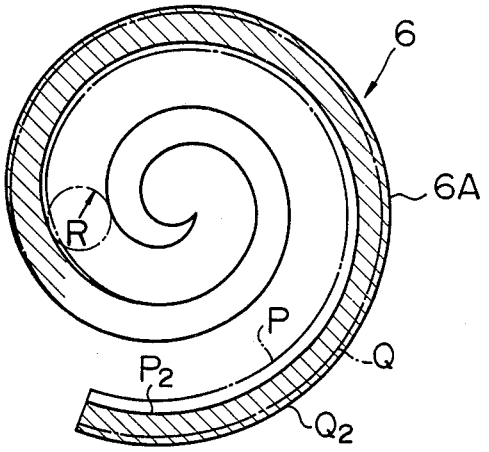
FIG. 6 is a partial plan view of a wrap portion of the fixed scroll in accordance with a second embodiment of the present invention.

FIG. 6 relates to a second embodiment of the present invention and shows a case in which the present invention is applied to the wrap 6A of the fixed scroll 6. In this cased, the wrap 3A, i.e., the opposing wrap, of the orbiting scroll 3 is formed with the theoretical involute curve 2A. In the wrap 6A of the fixed scroll 6, one inner wall surface $Q_2$ of the wrap is provided outwardly of the outer wall surface Q of the wrap of the theoretical involute curve 2A, while the other inner wall surface $P_2$ of the wrap is disposed outwardly of the inner wall surface P of the wrap of the theoretical involute curve 2A. In addition, in the case of the fixed scroll 6, the inscribed circle radius R is set in such a manner as to become gradually greater from the beginning of the spiral toward the end of the spiral, contrary to the case of the orbiting scroll 3.

As has been described above, in accordance with the present invention, the wrap wall surface of either one of the scroll members is formed beforehand or in advance such as to be offset radially relative to a theoretical involute curve by taking into consideration the amount of thermal expansion of the orbiting scroll and, hence, the difference in its thermal expansion relative to that of the fixed scroll. Therefore, it is possible to operate the apparatus as a vacuum pump while maintaining very small gap between the wraps without any collision or contact occurring between them. Consequently, the reliability and the discharge efficiency of the pump can be enhanced.

What is claimed is:

1. A scroll type pump having an orbiting scroll provided with a wrap constituted by a spiral projection on a plate and a fixed scroll provided with a wrap constituted by a spiral projection on another plate, said scrolls being engaged with each other at an offset of 180 degrees, and adapated to compress or expand a fluid by allowing said orbiting scroll to effect orbital motion relative to said fixed scroll without rotating said orbiting scroll, wherein said wrap of said fixed scroll has a fixed thickness and is formed spirally along a set curve, and said wrap of said orbiting scroll is arranged such that a radius of an inscribed circle between side walls of said wrap becomes gradually smaller from a beginning of a spiral in a center portion of said wrap toward an end of said spiral in an outer peripheral portion of thereof.

2. A scroll type pump according to claim 1, wherein said wrap of said orbiting scroll has a fixed thickness from the beginning of said spiral in said center portion of said wrap to the end of said spiral in said outer peripheral portion of said wrap.

3. A scroll type pump according to claim 1, wherein said wrap of said orbiting scroll is arranged such that one side wall surface thereof is offset from a theoretical involute curve in such a manner that the wrap thickness becomes smaller, and the other side wall surface thereof is offset in such a manner that said wrap thickness becomes greater.

4. A scroll type pump according to claim 3, wherein the curve of said side wall surface of said wrap of said orbiting scroll formed spirally is set to meet a condition $\Delta t_1 \geqq \Delta t_2$, where $\Delta t_1$ is an amount in which said wrap thickness is decreased from said theoretical involute curve at an outermost peripheral portion, and $\Delta t_2$ is an amount thereat in which it is increased from the same.

5. A scroll type pump according to claim 1, wherein an orbit radius $\epsilon_R$ of said orbiting scroll has a fixed dimension and is set to meet a condition $\epsilon_R \leqq \epsilon th - \Delta t_2$, where $\epsilon th$ is a theoretical orbit radius determined from a theoretical involute curve in a case where said wrap thickness is not varied.

6. A scroll type pump according to claim 1, wherein both side wall surfaces of said wrap are formed such as to be offset from theoretical involute curves outwardly from points of contact of said wraps of said orbiting scroll and said fixed scroll defining a minimal hermetic space in said center portions of said wraps.

7. A scroll type pump having an orbiting scroll provided with a wrap constituted by a spiral projection on a plate and a fixed scroll provided with a wrap constituted by a spiral projection on another plate, said scrolls being engaged with each other at an offset of 180 degrees, and adapted to compress or expand a fluid by allowing said orbiting scroll to effect orbital motion relative to said fixed scroll without rotating said orbiting scroll, wherein said wrap of said orbiting scroll has a fixed thickness and is formed spirally along a set curve, and said wrap of said fixed scroll is arranged in such a manner that the radius of an inscribed circle between side walls of said wrap becomes gradually larger from a beginning of a spiral in a center portion of said wrap toward an end of said spiral in an outer peripheral portion of thereof.

8. A scroll type pump according to claim 7, wherein said wrap of said fixed scroll has a fixed thickness from the beginning of said spiral in said center portion of said wrap to the end of said spiral in said outer peripheral portion of said wrap.

9. A scroll type pump according to claim 7, wherein said wrap of said fixed scroll is arranged such that one side wall surface thereof is offset from a theoretical involute curve in such a manner that a wrap thickness becomes smaller, and the other side wall surface thereof is offset in such a manner that said wrap thickness becomes greater.

10. A scroll type pump according to claim 7, wherein the curve of said side wall surface of said wrap of said fixed scroll formed spirally is set to meet a condition $\Delta t_1 \geqq \Delta t_2$, where $\Delta t_1$ is an amount in which said wrap thickness is decreased from said theoretical involute curve at an outermost peripheral portion, and $\Delta t_2$ is an amount thereat in which it is increased from the same.

11. A scroll type pump according to claim 7, wherein an orbiting radius $\epsilon_R$ of said orbiting scroll has a fixed dimension and is set to meet a condition $\epsilon_R \leqq \epsilon th - \Delta t_2$, where $\epsilon th$ is a theoretical orbiting radius determined from a theoretical involute curve in a case where said wrap thickness is not varied.

12. A scroll type pump according to claim 7, wherein both side wall surfaces of said wrap are formed such as to be offset from theoretical involute curves outwardly from points of contact of said wraps of said orbiting scroll and said fixed scroll defining a minimal hermetic space in said center portions of said wraps.

13. A scroll type pump having an orbiting scroll provided with a wrap constituted by a spiral projection on a plate and a fixed scroll provided with a wrap constituted by a spiral projection on another plate, said scrolls being engaged with each other at an offset of 180 degrees, and adapted to compress or expand a fluid by allowing said orbiting scroll to effect orbital motion relative to said fixed scroll without rotating said orbiting scroll, wherein said wrap of said fixed scroll has a fixed thickness and is formed spirally along a set curve, and said wrap of said orbiting scroll is formed such that a widthwise center line thereof becomes a spiral curve having an amount of offset which gradually increases inwardly of said set curve from a beginning of the spiral in a center portion of said wrap toward an end of the spiral in an outer peripheral portion of said wrap.

14. A scroll type pump having an orbiting scroll provided with a wrap constituted by a spiral projection on a plate and a fixed scroll provided with a wrap constituted by a spiral projection on another plate, said scrolls being engaged with each other at an offset of 180 degrees, and adapted to compress or expand a fluid by allowing said orbiting scroll to effect orbital motion relative to said fixed scroll without rotating said orbiting scroll, wherein said wrap of said orbiting scroll has a fixed thickness and is formed spirally along a set curve, and of said wrap of said fixed scroll is formed such that a widthwise center line thereof becomes a spiral curve having an amount of offset which gradually increases outwardly of said set curve from a beginning of the spiral in a center portion of said wrap toward an end of the spiral in an outer peripheral portion of said wrap.

* * * * *